US007631364B2

(12) United States Patent
Culler et al.

(10) Patent No.: US 7,631,364 B2
(45) Date of Patent: Dec. 15, 2009

(54) PROTECTIVE GARMENT ENSEMBLE

(75) Inventors: Gregory D. Culler, Nottingham, PA (US); Joanne G. Pheris, North East, MD (US)

(73) Assignee: Gore Enterprise Holdings, Inc., Newark, DE (US)

( * ) Notice: Subject to any disclaimer, the term of this patent is extended or adjusted under 35 U.S.C. 154(b) by 0 days.

(21) Appl. No.: 10/901,473

(22) Filed: Jul. 28, 2004

(65) Prior Publication Data

US 2006/0021118 A1 Feb. 2, 2006

(51) Int. Cl.
*B63C 11/04* (2006.01)

(52) U.S. Cl. ..... 2/2.17; 2/84

(58) Field of Classification Search ..... 2/69, 2/81, 82, 456, 457, 458, 97, 243.1, 79, 2.17, 2/78.3, 167, 69.5, 93, 94, 901, 84, 202
See application file for complete search history.

(56) References Cited

U.S. PATENT DOCUMENTS

| | | | | |
|---|---|---|---|---|
| 1,097,530 | A * | 5/1914 | Cabelinsky | 2/84 |
| 5,809,572 | A * | 9/1998 | Sisolak | 2/173 |
| 5,845,340 | A * | 12/1998 | Frislie | 2/202 |
| 5,940,879 | A * | 8/1999 | Whitehouse | 2/2.17 |
| 6,357,048 | B2 * | 3/2002 | Griffiths | 2/2.17 |
| 6,415,453 | B1 * | 7/2002 | Anderson et al. | 2/458 |
| 6,604,248 | B1 * | 8/2003 | Brown | 2/456 |
| 6,792,625 | B2 * | 9/2004 | Hexels | 2/457 |

* cited by examiner

*Primary Examiner*—Tejash Patel
(74) *Attorney, Agent, or Firm*—Carol A. Lewis White

(57) ABSTRACT

A protective garment ensemble comprising a suit having arm-receiving and leg-receiving portions, a hood portion and an opening adjacent the hood opening through which the suit can be donned and doffed and which mates with a removable face portion, the ensemble having mating fastener components around the suit opening and the face portion to form a seal between the suit and the removable face portion.

21 Claims, 5 Drawing Sheets

PROTECTIVE GARMENT ENSEMBLE

FIELD OF THE INVENTION

This invention relates to protective garment ensembles for use in a variety of potentially harmful environments such as fire, chemical and/or biological conditions.

BACKGROUND OF THE INVENTION

Current standard practice for responders to hazardous conditions is to wear a fully encapsulated suit when using a self contained breathing apparatus ("SCBA") in a Hazardous Materials ("HAZMAT") incident requiring vapor protection. In a fully encapsulated suit the responder and the SCBA are completely inside a protective suit to prevent vapor ingress that could harm or contaminate the responder's skin, lungs, etc. These suits are typically designed to meet the most stringent protection levels such as the National Fire Protection Association ("NFPA") Level A standard.

In HAZMAT incidents where liquid and vapor personal protection are preferred or necessary, the wearer will normally use a SCBA and dress in a fully encapsulated suit, commonly referred to as a Level A ensemble design. Due to the cumbersome nature of encapsulating suits and the need to minimize the number of sealed openings, serious efforts have focused on encapsulating garment designs which could be easily donned and doffed and which had only one sealed opening. For example, U.S. Pat. No. 4,038,698 to Smith describes a one-piece rainsuit and mask which has a single zipper extending from the neck to the ankle to facilitate donning and doffing. Subsequently, U.S. Pat. No. 5,289,059 to Covington describes advantages of a one-piece jumpsuit having a single zipper that extends from the crotch to the neck and then further extends from the neck to the sleeve. In both of these garment designs, the fact that a zipper extends to the neck is problematic due to the difficulties in making a comfortable, liquid proof seal at the neck-end of the zipper between the garment and the wearer's neck.

One way that this problem has been overcome is by the use of a neck-dam which slides over the wearer's head in combination with a zipper elsewhere on the garment through which the garment can be donned and doffed. For example, UK Patent Application No. GB 2,079,141 to Gugen describes a protective suit that has a single zipper that extends across the front of the body coverall through which the garment is donned and doffed and with a separate neck-dam which can stretch to pass over the wearer's head, but then forms a seal around the wearer's neck.

An alternate approach to addressing the problem of sealing a zipper around a wearer's neck is to use a non-separating zipper which terminates close to, but not at the wearer's neck. UK Patent Application No. GB 2,357,235 to Duplock describes a garment in which a single, non-separating zipper extending from the chest region upward and around the back of the neck, then continuing back down to the center portion of the chest. When open, the wearer can don and doff this jumpsuit with ease, and a separate neck-dam can be used to form a liquid proof seal around the wearer's neck. A limitation of this garment design is that in a HAZMAT situation, the wearer would need to remove his/her breathing air supply in order to doff the potentially contaminated garment.

In many instances, the wearer is required to doff the Level A protective suits without removing his/her breathing air supply in order that the garment can be decontaminated or replaced. However, doffing the present Level A suits often require one's breathing air supply to be removed, thus exposing the wearer to potentially life-threatening agents.

In searching for designs to improve the liquid and vapor protection when using an SCBA, doffing the garment without compromising the respiratory protection becomes a problem. Many schemes have been attempted, but not succeeded, to eliminate the need of the wearer to remove or disconnect his supplied airline in order to doff an encapsulating suit. Removing one's airline prior to complete personal protective equipment decontamination can have serious health or life-threatening implications in certain HAZMAT incidents.

Thus, existing systems provide a limited protective solution because they force the wearer to risk potentially life-threatening exposures in order to doff a contaminated protective ensemble.

Accordingly, a need has existed for a protective ensemble having a fully encapsulating design that insures the protective garment is sealed from ingress of threats such as fire, chemical and biological assaults, and other hazardous threats, while also allowing for easy donning and doffing without compromising the wearer's supplied respiratory air system.

SUMMARY OF THE INVENTION

The present invention comprises a protective ensemble for use in protection against fire, chemical and/or biological threats, and other similar harmful environments which individuals may be exposed to under a variety of extreme conditions.

The protective ensemble comprises a suit having an appropriate construction that is protective against the challenges of interest; an opening in the suit through which the suit can be donned and doffed and which mates with the removable face portion of the ensemble and mating fastener components secured around the suit opening and the face portion to form a seal between the suit and the removable face portion when the fastener components are mated together. This protective ensemble can optionally include additional features and apertures for allowing devices such as a supplied respiratory air hose or protective mask or similar device to be used. As required for the entire ensemble, these additional features and/or apertures include appropriate means for preventing the ingress of challenges against which protection is desired. While not intended to limit the scope of this invention, this invention is particularly well suited for protection against hazardous liquids and vapors, such as, but not limited to chemical and biological agents.

The suit portion of the invention includes arm-receiving and leg-receiving portions for accommodating a wearer's arms and legs during use and a hood region for covering the wearer's head. Depending on the level of threat to which the wearer may be exposed, the number of openings in the suit portion may vary. In the case of extremely harmful threats, the fewer openings in the garment requiring sealing, the less opportunity for leaks in the garment and, resultingly, the better the protection for the wearer. Thus, in one embodiment, the suit comprises a unitary piece with only one opening in the hood region appropriately sized for the wearer to don and doff the suit and a fastener component around the perimeter of the suit opening matingly sealable with the fastener component on the removable face portion. Where the environmental threat to the wearer may not be as severe, it may be desirable that the suit comprise multiple pieces, such as a top with arm-receiving portions, a hood portion and an opening through which the suit may be donned and doffed which is matingly sealable to the face portion, and pants with leg-receiving portions, wherein a further seal is provided between the top and pant pieces of the suit.

The removable face portion is oriented generally adjacent the wearer's face and has a fastener component at or adjacent its perimeter for matingly sealing to the suit portion of the ensemble. The face portion may typically have a visor, mask, or other means for the wearer to see through the ensemble. The removable face portion may also optionally be supplied with an air port for a supplied respiratory air line to pass to the wearer. In another embodiment, a combination mask and breathing apparatus (e.g., an SCBA or the like) may be sealed to or with the removable face portion. Additional functional capabilities which provide comfort, safety, etc., to the wearer are also contemplated to be provided through the removable face portion in a sealed manner, depending on the environmental conditions to which the wearer is exposed.

The suit and the face portion are sealed together at the perimeter of the suit opening and the removable face portion. The fastener used to form the sealed perimeter can be any suitable separating fastener that allows the suit to be totally separated from the removable face portion including, but not limited to, separating zippers and rail-type closures which seal the interior of the protective ensemble from the surrounding environment.

DETAILED DESCRIPTION OF THE INVENTION

An encapsulating protective ensemble for use with supplied respiratory air systems is provided.

Figure 1:
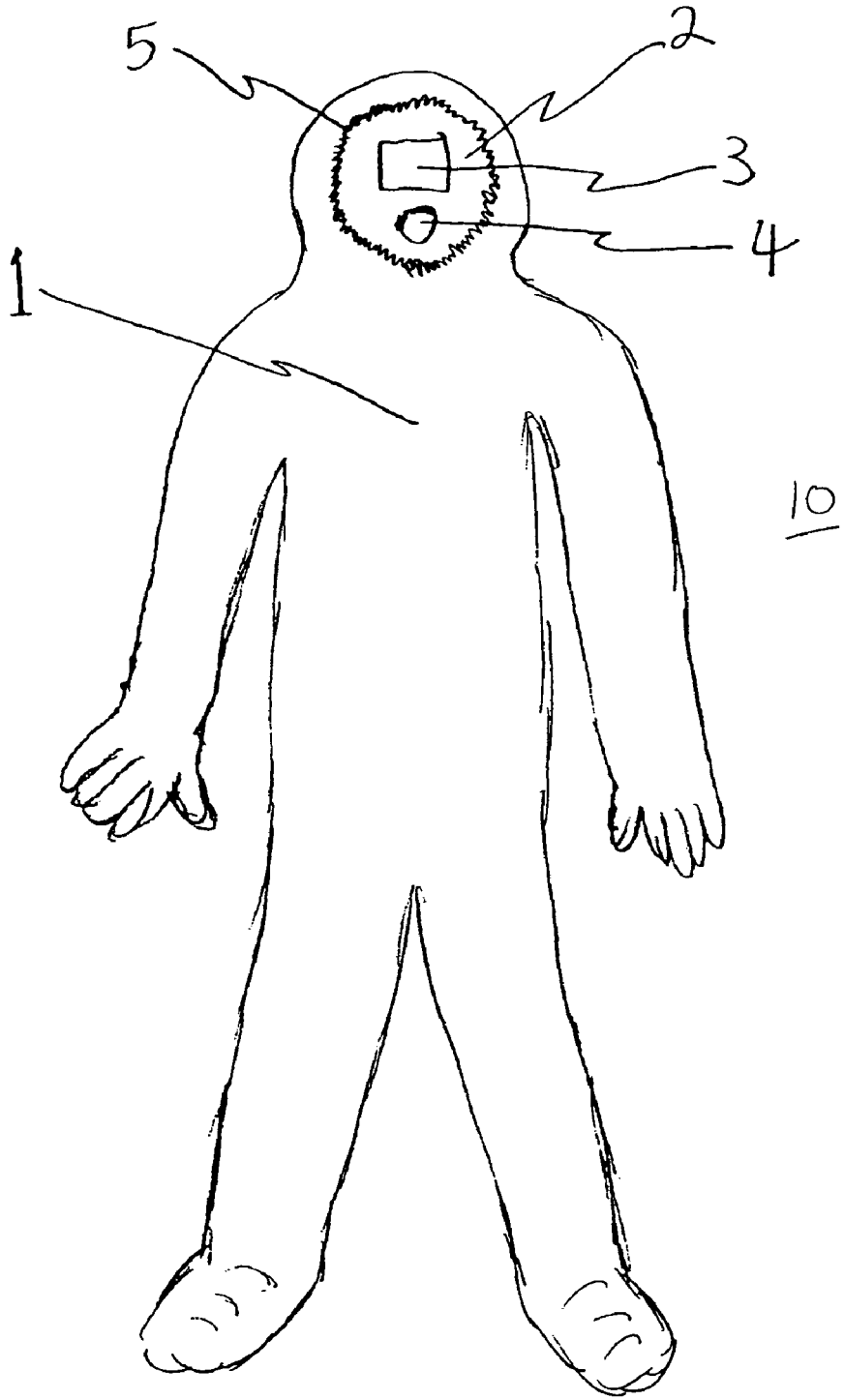
FIG. 1 is a front view of a protective ensemble containing a removable face portion according to the invention.

Turning to the figures, FIG. 1 shows one aspect of the invention wherein the encapsulating protective ensemble 10 is shown to include a suit 1 with a hood region 9 and an adjacent opening depicted by the perimeter 5, removable face portion 2 comprising fabric, a visor, or mask, 3, a port 4 for a respirator or alternate breathing means, and a seal between the suit 1 and the face portion 2 at perimeter 5. The sealing at the perimeter 5 can be accomplished by any fastener capable of sealing the removable face portion 2 to the suit 1. The fastener used to form the sealed perimeter can be any suitable separating fastener that allows the suit 1 to be totally separated from the removable face portion, such as but not limited to separating zippers and rail-type closures. The dimensions of the opening in the suit must be sufficiently large to allow the wearer to don and doff the protective ensemble by passing his or her entire body through this opening. Importantly, if a breathing air port is included in the removable face portion 2, a suitable sealing means must also be provided between the port and the breathing device which passes therethrough. Such seals may comprise an elastomeric material such as neoprene or butyl rubber that is formed into a suitable geometry so as to form a seal with the breathing device.

Figure 2:
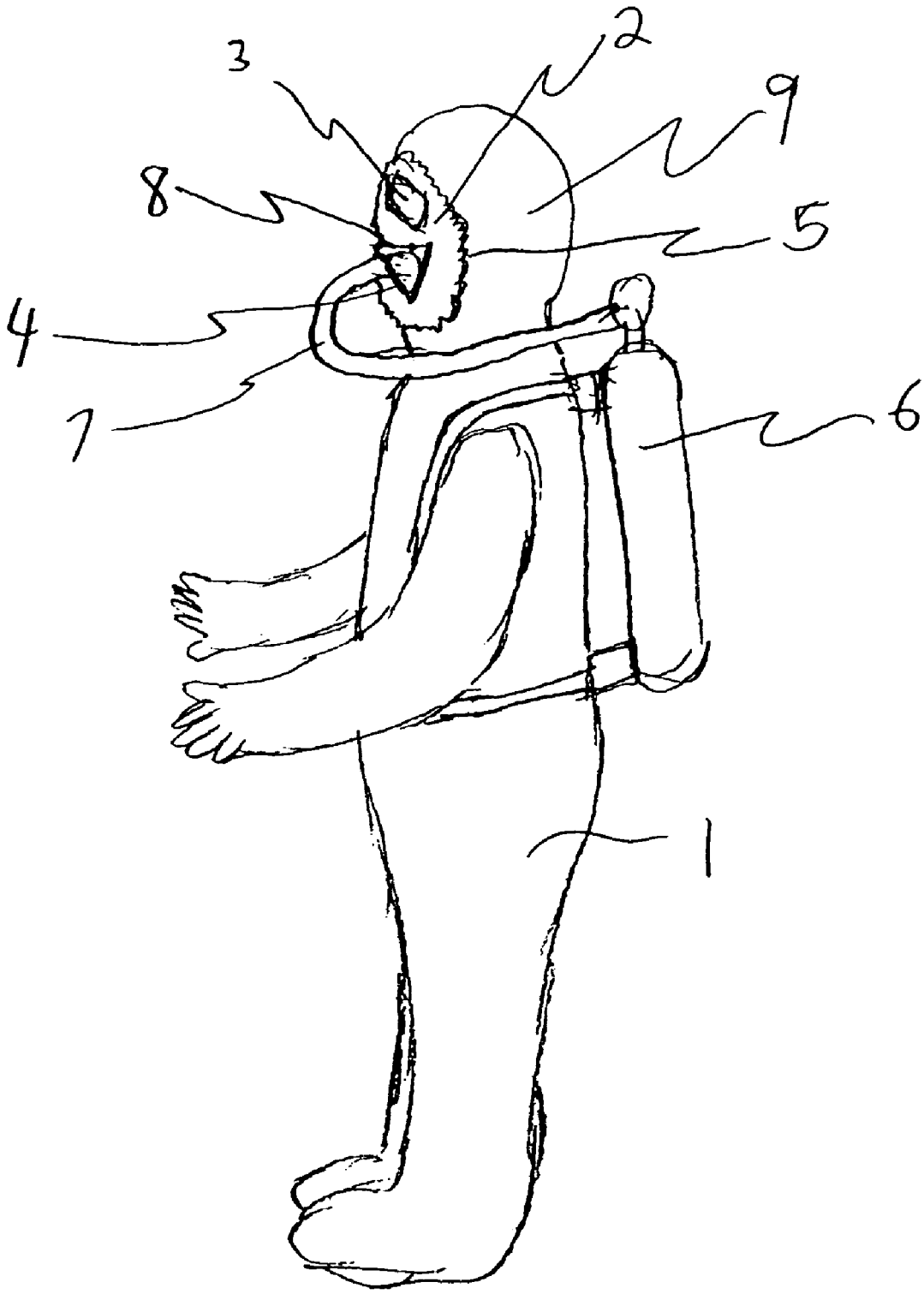
FIG. 2 is a side view of a protective ensemble containing a removable face portion according to the invention.

In a side perspective view of an encapsulating protective ensemble, shown in FIG. 2, as above, suit 1 is attached to the removable face portion 2 at sealed perimeter 5. An air line 7 provides supplied respiratory air from air tank 6 to breathing mask 8 which is sealed to removable face portion 2 by air port 4. Visor 3 is provided for the wearer to see to the outside through the ensemble. A main advantage of this invention is that after exposure to contaminating agents, the protective ensemble 1 can be doffed without necessitating the wearer's removal of his supplied breathing air.

Figure 3:
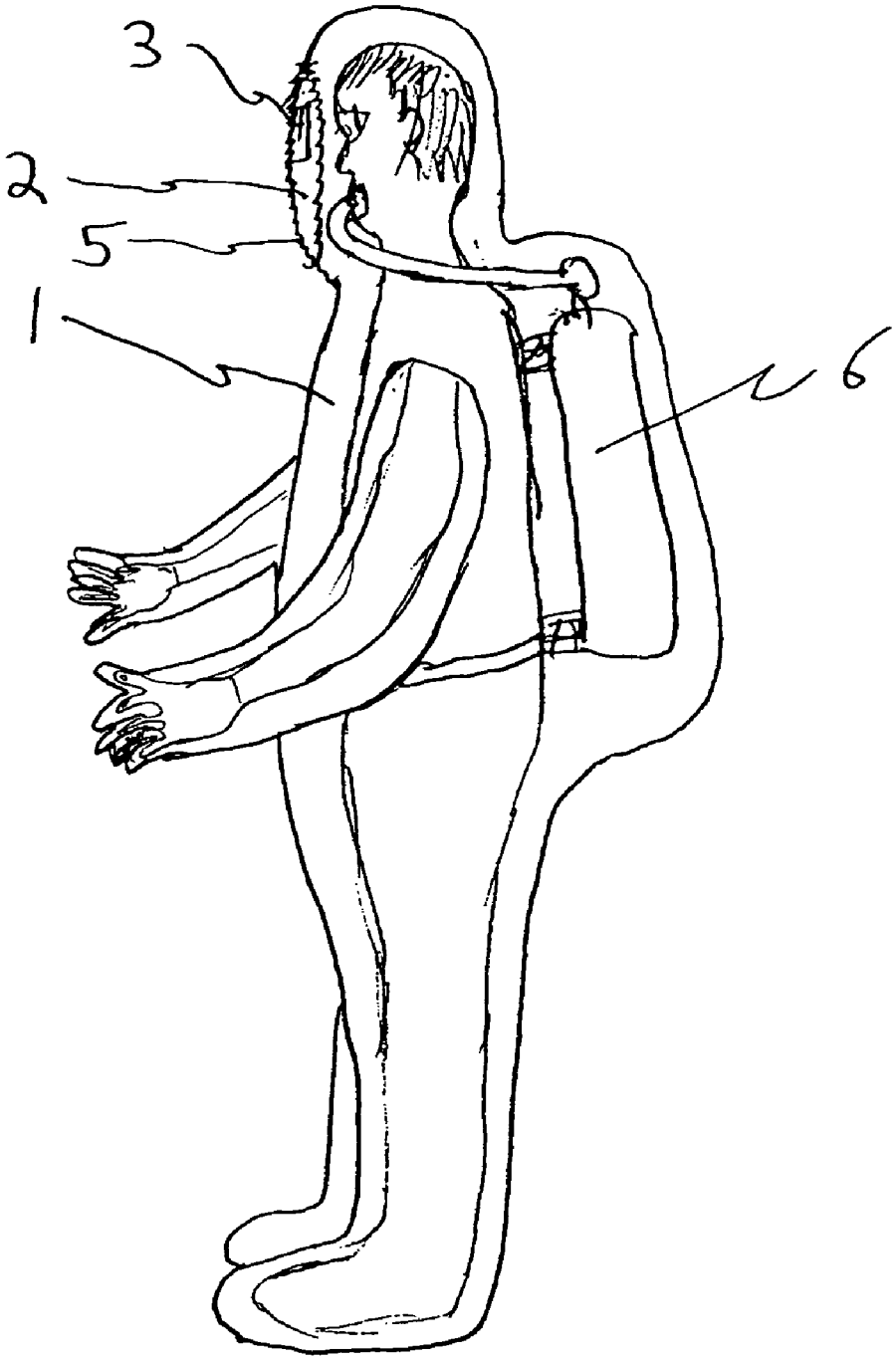
FIG. 3 is a cut-away side perspective view of a person wearing a protective ensemble within which a SCBA tank can be worn and with a removable face portion according to the invention.

In an alternate embodiment, depicted in FIG. 3 showing a cut-away side perspective view of a person wearing a protective ensemble, the protective ensemble may be configured so that a supplied air tank 6 can be worn beneath the suit 1. In such an embodiment, the breathing air port can be eliminated from the removable face portion 2, leaving just the visor 3 for visibility. The opening in the suit in such an embodiment will be sufficiently large that the wearer can don and doff the suit while wearing the air tank 6.

Figure 4:
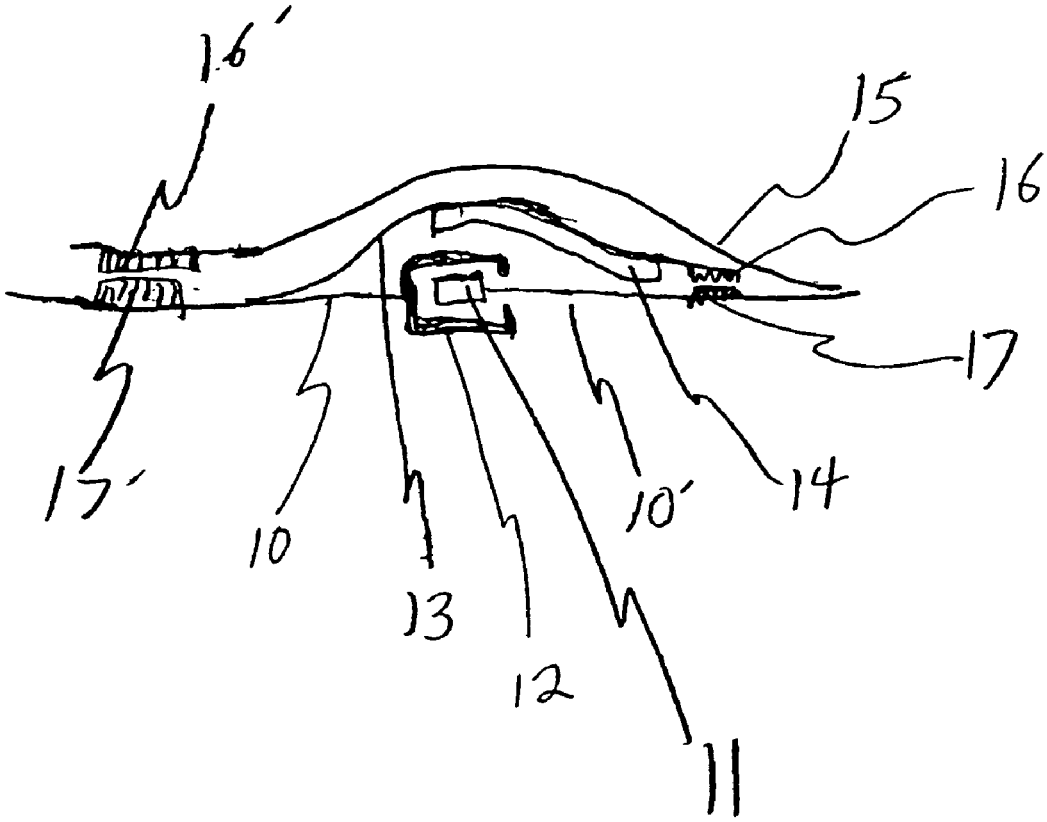
FIG. 4 is a perspective view of one alternative sealing construction for sealing the removable face portion to the remainder of the protective suit.

As noted earlier, the suit and the face portion are sealed at the perimeter by any suitable fastener means which seals the interior of the protective ensemble from the surrounding environment. In one embodiment, a fastener can seal the portions at the perimeter by incorporating overlapping flexible materials. FIG. 4 shows an embodiment wherein protective barrier material 10' is attached to the male portion 11 of a zipper. The female portion 12 of the zipper is attached to barrier material 10 from the opposite portion of the opening to be sealed. To insure adequate liquid and vapor protection, a flap of barrier material 13 with affixed elastomeric strip 14 can be sewn or otherwise attached to barrier material 10 and located such that the elastomeric strip 14 resides over the zipper formed when the two halves of the zipper 11, 12 are mated. A means for securing flap 13 to the barrier material 10' can be provided, such as hook 16 and loop 17 strips (e.g. VELCRO™ fastener) affixed to flap 13, as shown, may work well for this purpose. To further protect against vapor ingress, an additional flap of flexible barrier material 15 can optionally be provided that is sewn or otherwise attached to barrier material 10' and traverses the sealed region from the side opposite to flap 13 and which is again secured to barrier material 10 by a suitable fastening means, such as a hook 16' and loop 17' strip. One advantage of this type of sealing construction is that it provides pressure relief from within the fully encapsulating ensemble. When the wearer moves about, and in particular when bending over, the pressure in the suit increases slightly. This increased pressure can push outward through the zipper 11, 12 and against the elastomeric strip 14, causing it to lift slightly and allow the pressure to escape. Yet, if the pressure is greater outside the suit, flap 13 and optional flap 15 will press the elastomeric seal 14 against zipper parts 11, 12 and against the barrier material 10 and 10', further enhancing the performance of the protective seal.

Figure 5:
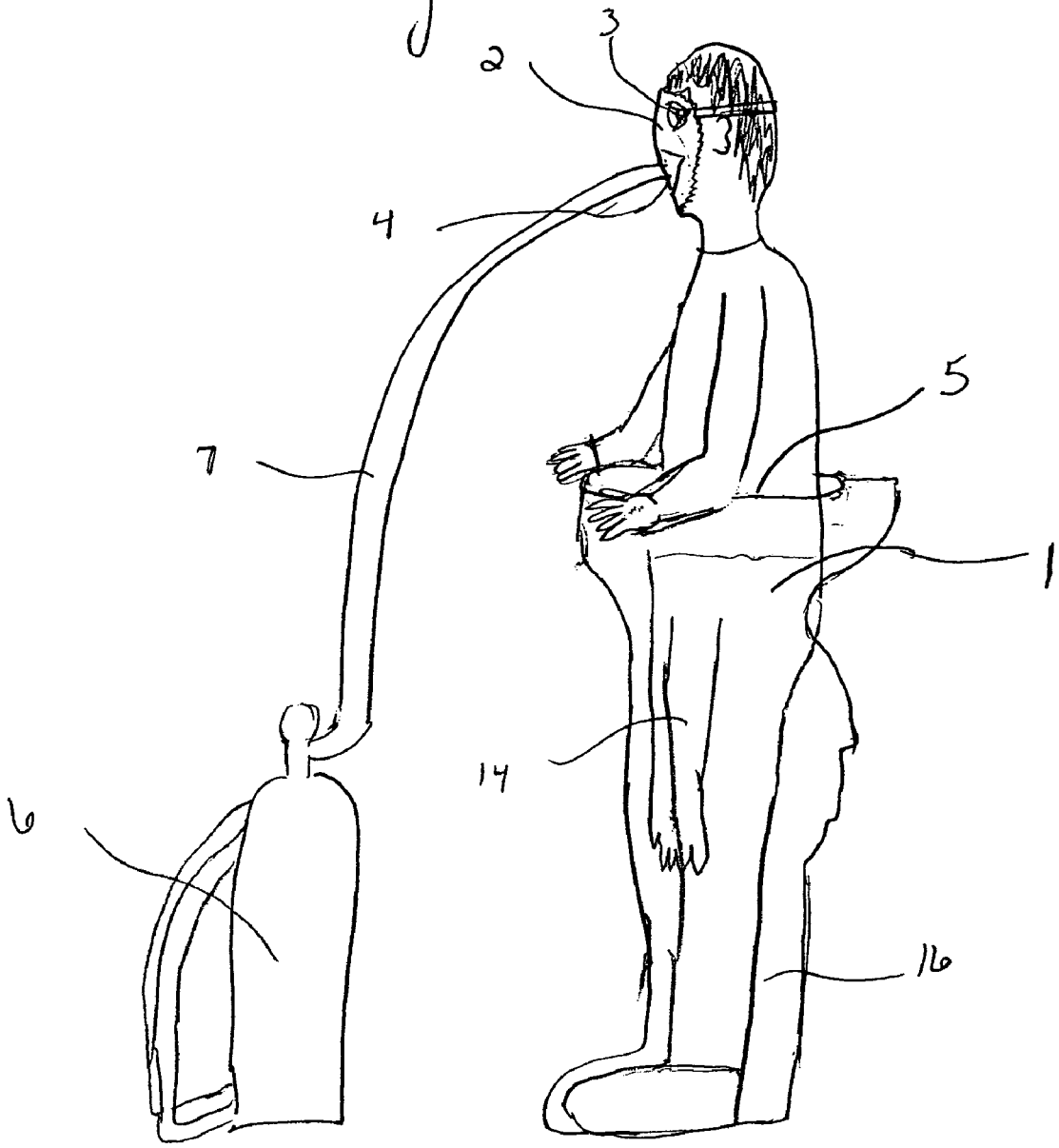
FIG. 5 is a partial cut-away side perspective view of a person donning or doffing a protective ensemble of the invention, such as shown in FIG. 2, wherein the removable face portion and attached air supply is in place on the wearer's face.

FIG. 5 shows a partial cut-away side perspective view of a person donning or doffing a suit 1 of the protective ensemble of the invention, such as the protective ensemble shown in FIG. 2, wherein the removable face portion 2 having the attached air supply (i.e., via air port 4, air line 7 and air tank 6) is in place on the wearer's face. The person is able to don and doff the suit 1 via the opening depicted by perimeter 5, and the leg-receiving 16 and arm-receiving 14 portions accommodate the legs and arms of the wearer, respectively With respect to suitable constructions of the protective ensemble of the invention, the ensemble construction should provide the necessary level of protection as prescribed by the end application and preferably may be sufficiently flexible so as to provide relative comfort and ease of movement to the wearer. For example, a variety of fabric constructions are available from which to choose depending on the level of threat to which the wearer will be exposed. In the case of chemical and biological protective ensembles, for example, suitable fabric constructions should also pass the vapor permeation and liquid penetration tests set forth herein. For example, in one embodiment, the fabric construction may be comprised of at least one woven, knit or nonwoven textile material and at least one barrier material. "Barrier material" refers to any material capable of providing permeation resistance against the environmental challenges required for the specific end application. The textile may include synthetic fibers, natural fibers, or blends of synthetic and natural fibers. The barrier material may be laminated to the textile, coated onto the textile, imbibed into the textile, or otherwise affixed adjacent to the textile.

In one aspect of the invention, a suitable fabric construction for the protective ensemble comprises at least one layer of fabric material and at least one layer of barrier material. The textile and barrier material may be provided as a laminate of at least one fabric layer and at least one barrier film material produced by any suitable method. Suitable materials are known in the art and include, but are not limited to, those as described in, for example, U.S. Pat. No. 5,289,644 to Driskill et al. For example, such laminates can be produced by printing an adhesive onto one layer in a discontinuous pattern, in an intersecting grid pattern, in the form of continuous lines of adhesive, as a thin continuous layer, etc., and then introducing the second layer in a way that the adhesive effectively joins and adheres together the two adjacent surfaces of an expanded polytetrafluoroethylene ("ePTFE") based barrier film and the textile material. The textile layer typically provides at least some abrasion resistance to help protect the barrier film material.

An optional second textile layer may be present on the inside of the fabric construction and typically provides at least some abrasion resistance to the side of the barrier material opposite the first textile layer and to provide a more comfortable surface to the wearer. The second textile layer may comprise a woven, knit, nonwoven textile, or any other flexible substrate comprising textile fibers including, but not limited to, flocked fibers. The inclusion of a second textile layer creates what is often referred to as a "3 layer" laminate.

Alternatively, the textile and the barrier material can be detached from each other except at isolated discrete connection points such as around a perimeter of the article and/or at irregular, sporadic intervals.

In the case of protective ensembles for chemical and biological resistance, the barrier material in the fabric layer should be resistant to chemical and biological penetration and diffusion since it provides much of the protective nature of the fabric construction.

One suitable barrier material useful for chemical and biological protective fabric construction is a composite including polytetrafluoroethylene film. Exemplary polytetrafluoroethylene-containing protective fabric constructions are available from W. L. Gore and Associates under part number ECAT 614001B. Such protective fabric constructions provide excellent chemical penetration and permeation resistance in addition to high thermal stability, both properties that are required for applications such as fire fighting and hazardous material handling. In addition, the impermeable nature of this type of protective fabric construction provides excellent biological protection, making it ideal for many types of emergency medical personnel. Alternatively, the barrier material used in the chemical and biological protective fabric construction can be any suitable waterproof, breathable or nonbreathable layer capable of providing the necessary level of protection. For example, the fabric constructions known under the tradename Tychem®fabric (from DuPont) are acceptable for many conditions.

Constructions of the components of the protective ensemble may vary widely, again depending on the threat to which the wearer may be exposed. For example, conventional sewing techniques may be sufficient for certain conditions; whereas, conversely, in the case of protective ensembles for chemical and biological conditions, additional construction steps such as sealing the sewn seams with barrier seam tape or the like may be appropriate. Other textile or laminate joining techniques such as gluing, welding, and the like may also be employed to construct protective ensembles of the present invention.

The following non-limiting example is provided to further exemplify aspects of the invention.

EXAMPLE

A suit including leg-receiving portions and arm-receiving portions and a hood portion with a single circular opening for donning and doffing measuring about 50 inches in circumference was constructed from a three layer chemical/biological protective fabric (Part number ECAT 614001B, from W. L. Gore and Associates, Inc., Elkton, Md.) and the sewn seams were sealed with seam-covering tape. One half of a 50 inch water-resistant separating zipper was sewn around the perimeter of the opening in the hood so that the zipper terminated in close proximity to the zipper start point.

A face portion having a mask adapter section was constructed from the same materials described above. Specifically, the outer perimeter of the face portion was cut so that it matched the inner diameter of the circle formed by the half of the water resistant separating zipper attached to the hood opening. The other half of the water resistant separating zipper was sewn to the outer perimeter of the face portion.

The central portion of the face portion was modified by additional cutting and sewing to fit a mask associated with a self contained breathing apparatus (SCBA). For this example, the mask was a Spiromatic S3 (Interspiro, Inc. Branford, Conn.). Gaskets were cut from 0.060" thick neoprene rubber sheet (McMaster Carr PN 8568K521) and used to seal around the openings made to accommodate the mask. The neoprene rubber sheet was selected to provide a seal to eliminate any mass transfer from inside to outside the suit due to pressure changes caused by movement.

To seal around the SCBA mask visor, a channel was formed by sewing elastic around the inside of the opening cut for the mask and sewing an additional section of fabric with an identical opening to the inside of the hood. In this example, the inner fabric material was a three layer construction with Nomex jersey knit on both sides The opening on this inner layer was also elasticized. The stitch line joining these two pieces was situated approximately 1" outside the elasticized openings. Stitching in this manner resulted in an elastic "U" channel that would form around the inner and outer edges of the mask visor.

All sewing was performed using a conventional sewing machine, and all seams were sealed with protective seam-covering tape.

What is claimed:

1. A protective garment ensemble comprising:

a suit including leg-receiving and arm-receiving portions and a hood portion, said suit having an opening solely in the hood portion and not extending into the suit beyond the hood portion through which the suit can be donned and doffed, said opening having a perimeter with a first fastener component thereon; and a removable face portion having a second fastener component for mating with said first fastener component.

2. The protective garment ensemble of claim 1, wherein said suit comprises one piece.

3. The protective garment ensemble of claim 1, wherein said suit comprises multiple pieces.

4. The protective garment ensemble of claim 1, wherein said suit comprises a fabric.

5. The protective garment ensemble of claim 4, wherein said fabric comprises at least one textile layer and at least one barrier layer.

6. The protective garment ensemble of claim 1, wherein said suit comprises at least one barrier layer.

7. The protective garment ensemble of claim 5, wherein said fabric comprises a two-layer construction.

8. The protective garment ensemble of claim 5, wherein said fabric comprises a three-layer construction.

9. The protective garment ensemble of claim 4, wherein said at least one barrier layer comprises PTFE.

10. The protective garment ensemble of claim 1. wherein said removable face portion further includes a visor.

11. The protective garment ensemble of claim 1. wherein said removable face portion further includes a mask.

12. The protective garment ensemble of claim 1, wherein said removable face portion further includes an air port.

13. The protective garment ensemble of claim 1, wherein said removable face portion further includes a combination mask and breathing apparatus.

14. The protective garment ensemble of claim 1, wherein at least a portion of said removable face portion comprises fabric.

15. The protective garment ensemble of claim 14, wherein said fabric comprises at least one textile layer and at least one barrier layer.

16. The protective garment ensemble of claim 15, wherein said at least one barrier layer comprises PTFE.

17. The protective garment ensemble of claim 1, wherein said first fastener component comprises a first half of a separating zipper and said second fastener component comprises a second half of a separating zipper.

18. The protective garment ensemble of claim 1, wherein said first fastener component comprises a first half of a separating rail-type closure and said second fastener component comprises the mating second half of a separating rail-type closure.

19. The protective garment ensemble of claim 1, wherein said protective ensemble further includes at least one flap of barrier material oriented over said first and second fastener components.

20. The protective garment ensemble of claim 1. wherein said protective ensemble further includes two overlapping flaps of barrier material oriented over said first and second fastener components.

21. A protective garment ensemble comprising:

a unitary suit including leg-receiving and arm-receiving portions and a hood portion, said suit having a single opening solely in the hood portion and not extending into the suit beyond the hood portion through which the suit can be donned and doffed, said opening having a perimeter with a first fastener component thereon; and a removable face portion having a second fastener component for forming a seal with said first fastener component.

* * * * *